US008128013B2

(12) United States Patent
Bartelt et al.

(10) Patent No.: US 8,128,013 B2
(45) Date of Patent: Mar. 6, 2012

(54) HIGH EFFICIENCY SINGLE PASS SHREDDER-GRANULATOR

(76) Inventors: Doug Bartelt, Milwaukee, WI (US); Joseph Bartelt, Milwaukee, WI (US)

( * ) Notice: Subject to any disclaimer, the term of this patent is extended or adjusted under 35 U.S.C. 154(b) by 0 days.

(21) Appl. No.: 12/850,411

(22) Filed: Aug. 4, 2010

(65) Prior Publication Data

US 2011/0062263 A1 Mar. 17, 2011

Related U.S. Application Data

(60) Provisional application No. 61/243,482, filed on Sep. 17, 2009.

(51) Int. Cl.
*B02C 18/16* (2006.01)

(52) U.S. Cl. ..... 241/236; 241/242

(58) Field of Classification Search ..... 241/243, 241/236, 242

See application file for complete search history.

(56) References Cited

U.S. PATENT DOCUMENTS 3,931,935 A 1/1976 Holman
4,682,522 A 7/1987 Barclay
4,944,462 A 7/1990 Raterman et al.
4,976,178 A 12/1990 Barclay
5,062,576 A 11/1991 Burda
5,163,629 A 11/1992 Raterman et al.
5,562,255 A 10/1996 Witko et al.
5,799,884 A 9/1998 Alavi
5,992,777 A * 11/1999 Aagaard ..... 241/236
6,092,753 A 7/2000 Koenig
6,094,795 A 8/2000 Davenport
6,343,755 B1 2/2002 Barclay et al.
6,393,699 B1 5/2002 Koenig
6,616,077 B2 9/2003 Koenig

* cited by examiner

*Primary Examiner* — Mark Rosenbaum

(74) *Attorney, Agent, or Firm* — Absolute Technology Law Group, LLC

(57) ABSTRACT

The present invention is a shredder-granulator comprised of a plurality of rotary shear blades and a plurality of stationary bed knives fixedly attached to two counter-rotating shafts. The stationary bed knives are also secured to a frame. The shredder-granulator is capable of shredding and granulating materials in a single pass.

13 Claims, 8 Drawing Sheets

HIGH EFFICIENCY SINGLE PASS SHREDDER-GRANULATOR

CROSS-REFERENCE TO RELATED APPLICATIONS

This application claims priority to U.S. Provisional Application No. 61/243,482 filed on Sep. 17, 2009.

FIELD OF INVENTION

The present invention relates to the field of shredding and granulating machines, and more specifically to a highly efficient shredding and granulating machine that shreds and granulates in a single pass.

GLOSSARY

Figure 1A:
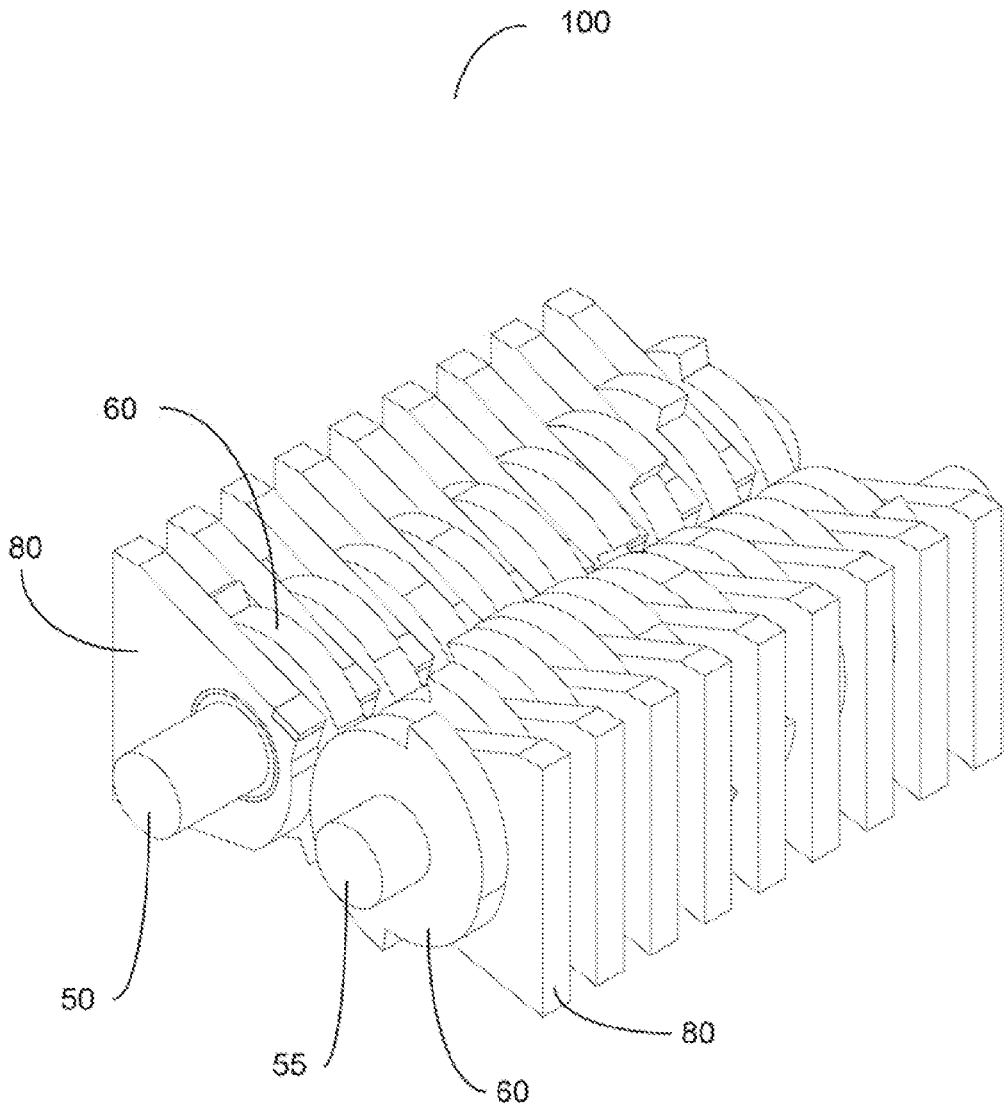
FIG. 1*a* illustrates a perspective view of an exemplary embodiment of a high efficiency single pass shredder-granulator.

As used herein, the term "shredder" refers to an apparatus that reduces a piece of material to elongated strips.

As used herein, the term "granulator" refers to an apparatus that reduces a piece of material to a shape other than an elongated strip including, but not limited to squares, chips, rounded, curved, torn, irregularly shaped, or cube shaped pieces.

As used herein, the term "frame" refers to a structure that supports the counter-rotating shafts and/or stationary bed knives of a shredding and/or granulating device.

As used herein, the term "shear blade" refers to a rotary cutting and/or shearing implement which may be affixed to a shaft.

As used herein, the term "stationary" means non-rotating. A stationary component may or may not be attached a frame or another component of a high efficiency single pass shredder-granulator.

As used herein, the term "stationary bed knife" refers to a non-rotating cutting surface.

As used herein, the term "feed chute" refers to a structural component adapted for manual or automated insertion of material.

As used herein, the term "rotating shaft" refers to a shaft to which shear blades are attached and which is powered by a drive mechanism, motor or other apparatus capable of rotating a shaft known in the art.

As used herein, the term "counter-rotating" means rotating in a direction opposite to another rotating component (e.g., a shaft).

As used herein, the term "pass" refers to each time a piece of material moves through the cutting edge or blade of a machine.

SUMMARY OF THE INVENTION

The present invention is a single pass high efficiency shredder-granulator having a plurality of rotary shear blades with a shearing surface, a plurality of stationary bed knives with a cutting surface, and two counter-rotating shafts. Each of the rotary shear blades and stationary bed knives has an aperture for assembling on a counter-rotating shaft. The rotary shear blades and stationary bed knives are alternatingly placed onto the two counter-rotating shafts. A spacer may be placed between each rotary shear blade and stationary bed knife.

The counter-rotating shafts are placed into a frame so that each rotary shear blade is opposite a stationary bed knife. The stationary bed knives are further secured to the inner edge of the frame so that the cutting surface is upward.

BACKGROUND

There are many problems related to the disposal of bulky waste materials, and attempts have been made in the art to reduce the number of sequential passes required to shred or granulate waste materials to the desired size. For example, U.S. Pat. No. 5,562,255 (Witko '255) teaches a tire-shearing machine that shreds and granulates in a single pass, using two different pairs of cutters. The tire shredding machine taught by Witko '255 is comprised of pairs of rollers which first flatten the tire. The rollers are positioned above a rotating primary shear so that the primary shear segments the flattened tire along a longitudinal axis into a plurality of longitudinal strips. The strips are then fed into an independent rotating secondary shear, placed below the primary shear. Pieces from the primary shear are held between shear members until a scraper forces the pieces into the secondary shear. The scraper also positions the pieces so that they are cut properly by the secondary shear. The secondary shear cuts along an axis perpendicular to the longitudinal axis cutting each of the longitudinal strips into a plurality of small chunks. The speed of each shear is controlled independently of the other allowing the size of the chunks produced to be varied.

The tire-shearing machine taught by Witko '255 is a somewhat complex design in that material to be shredded or granulated must pass though a first rotating shear, drop accurately, and then pass through a second rotating shear. The timing and coordination of both rotational processes is critical, and the settings must be adjusted to provide segmented pieces of a desired size. The separately rotating shears are subject to jamming, and the tire-shearing machine taught by Witko '255 requires four drive (motor) components to separately drive each of the four shafts.

A problem known with the tire-shearing machine taught by Witko '255 is that the material to be sheared or granulated must pass in a relatively uncontrolled manner from a first tier of rotating shears to a second tier of rotating shears. Additionally, the speed of the descent from the top tier of rotating shears to the bottom tier of rotating shears is uncontrolled, resulting in variable sizes of sheared and granulated materials.

It is desirable to have a single pass shredder-granulator that eliminates the need for two sets of rotating shears.

It is further desirable to have a single pass shredder-granulator that produces consistently sized shredded and/or granulated pieces.

It is further desirable to eliminate any distance between two sets of rotating shears where the speed or angle of descent of the material to be sheared or granulated cannot be physically controlled.

It is further desirable to have an efficiently designed shredder-granulator that minimizes the number of moving and assembled parts, and which can perform shredding and granulating processes in a single pass.

DETAILED DESCRIPTION OF INVENTION

For the purpose of promoting an understanding of the present invention, references are made in the text to exemplary embodiments of a high efficiency single pass shredder-granulator, only some of which are described herein. It should be understood that no limitations on the scope of the invention are intended by describing these exemplary embodiments. One of ordinary skill in the art will readily appreciate that alternate but functionally equivalent materials, components, number of components and designs may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* illustrates a perspective view of an exemplary embodiment of high efficiency single pass shredder-granulator 100 comprised of rotary shear blades 60, stationary bed knives 80, and counter-rotating shafts 50 and 55.

In the embodiment shown, counter-rotating shafts 50 and 55 rotate in opposite directions, and may be synchronized, unsynchronized, controlled by a single drive or motor, or separately powered. In the embodiment shown, counter-rotating shaft 50 rotates clockwise toward counter-rotating shaft 55, and counter-rotating shaft 55 rotates counterclockwise toward counter-rotating shaft 50.

In the embodiment shown, rotary shear blades 60 are mounted to round counter-rotating shafts 50 and 55. In various embodiments, rotary shear blades 60 may be secured to counter-rotating shafts 50 and 55 by bolting, clamping, or another means of attachment known in the art, and/or rotary shear blades 60 may be keyed to rounded shafts, or mounted to hexagonal shafts.

In the embodiment shown, stationary bed knives 80 are secured to counter-rotating shafts 50 and 55. In addition, stationary bed knives 80 are mounted to frame 30 (see FIG. 5*a*).

In the embodiment shown, there are eighteen shear blades 60 and eighteen stationary bed knives 80 secured on counter-rotating shafts 50 and 55. In other embodiments, there may be more or fewer rotary shear blades 60 and/or more or fewer stationary bed knives 80 mounted to counter-rotating shafts 50 and 55.

In various embodiments, rotary shear blades 60 and stationary bed knives 80 may be differently spaced at various points along counter-rotating shafts 50 and 55 and frame 30 (e.g., half an inch apart on one side and one inch apart on the other side, successively increasing or decreasing spacing from one end to the other).

Figure 1B:
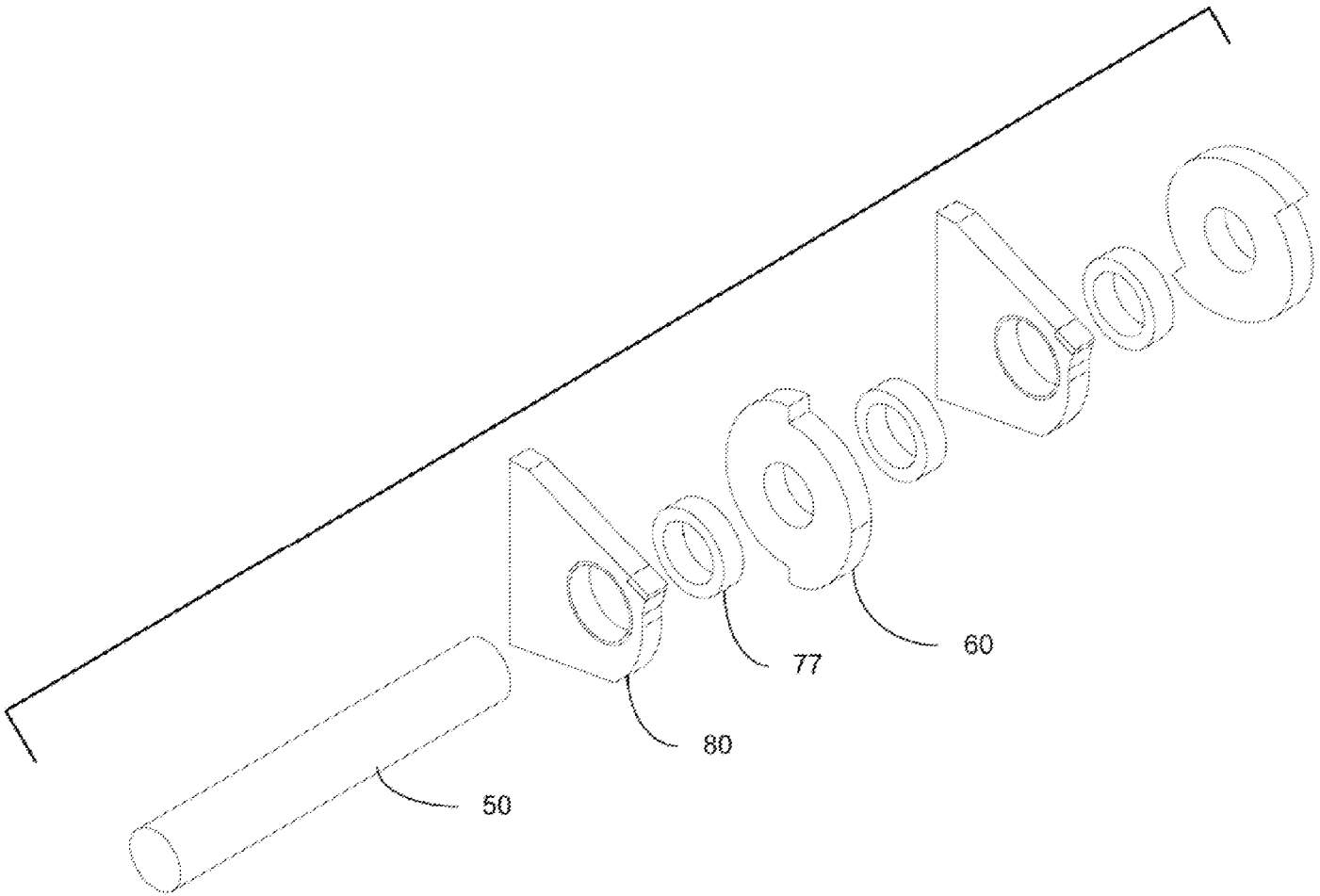
FIG. 1*b* illustrates an exploded view of an exemplary embodiment of a counter-rotating shaft, rotary shear blades, stationary bed knives, and spacers of a high efficiency single pass shredder-granulator.

FIG. 1*b* illustrates an exploded view of counter-rotating shaft 50, rotary shear blades 60, stationary bed knives 80, and spacers 77. In the embodiment shown, rotary shear blades 60 and stationary bed knives 80 are alternatingly placed on counter-rotating shaft 50.

In the embodiment shown, spacers 77 are located between rotary shear blades 60 and stationary bed knives 80 and consistently maintain the distance between rotary shear blades 60 and stationary bed knives 80, as well as ensure that the cutting surfaces of oppositely rotating rotary shear blades 60 (i.e., rotary shear blades 60 on counter-rotating shaft 50 and rotary shear blades 60 on counter-rotating shaft 55) are properly aligned.

FIGS. 2*a*, 2*b*, 2*c*, and 2*d* illustrate side views of various exemplary embodiments of rotary shear blade 60. Rotary shear blades 60 may include one or more hooked or curved shearing protuberances which are adapted to apply pressure sufficient to move material to a point between counter-rotating shaft 50 (not shown) and counter-rotating shaft 55 (not shown) so that there is sufficient pressure across the cutting surface of stationary bed knife 80 (not shown) and the shearing surface of rotary shear blade 60.

Figure 2A:
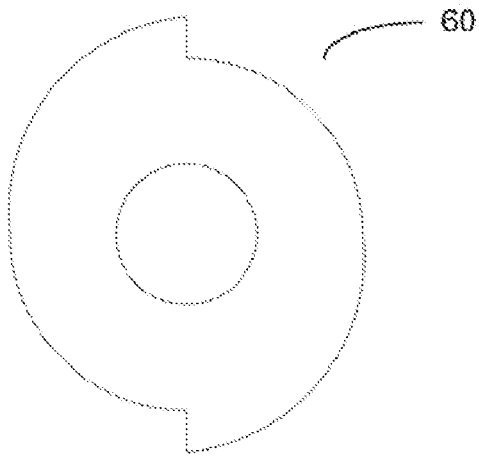
FIGS. 2*a*, 2*b*, 2*c*, and 2*d* illustrate side views of exemplary embodiments of a rotary shear blade for a high efficiency single pass shredder-granulator.
Figure 2B:
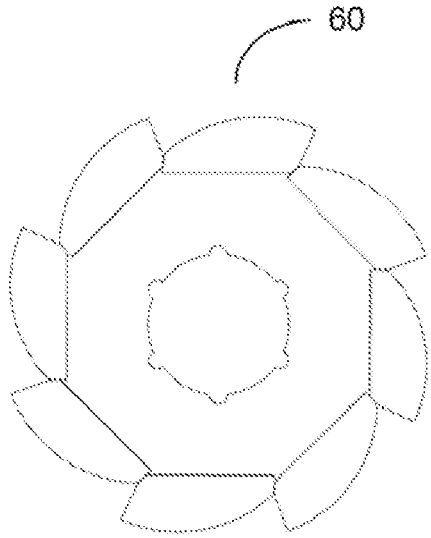
Figure 2C:
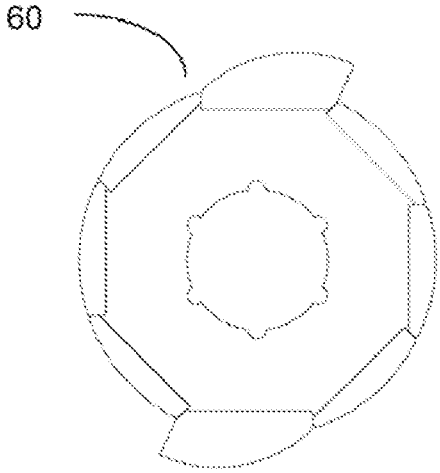
Figure 2D:
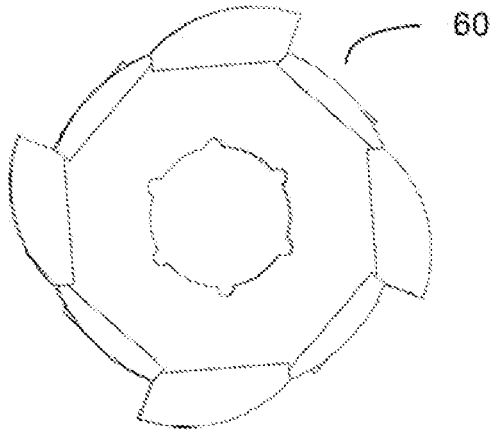

Rotary shears blades 60 may include any number of protuberances for moving and shearing material. Protuberances and/or the shearing surface may be integrally molded with rotary shear blade 60 (as shown in FIG. 2*a*) or may be separately attached to rotary shear blade 60 (as shown in FIGS. 2*b*, 2*c* and 2*d*) using bolts, clamps, or other attachment means known in the art. When the shearing surface is separately attached to rotary shear blade 60, the shearing surfaces may be removed when worn and replaced with new shearing surfaces.

In various embodiments, high efficiency single pass shredder-granulator 100 (not shown) may utilize rotary blades with pointed, I-shaped, v-shaped, or straight protuberances or shearing surfaces and/or rotary blades may have a textured or smooth surface to facilitate the movement of material.

Figure 3:
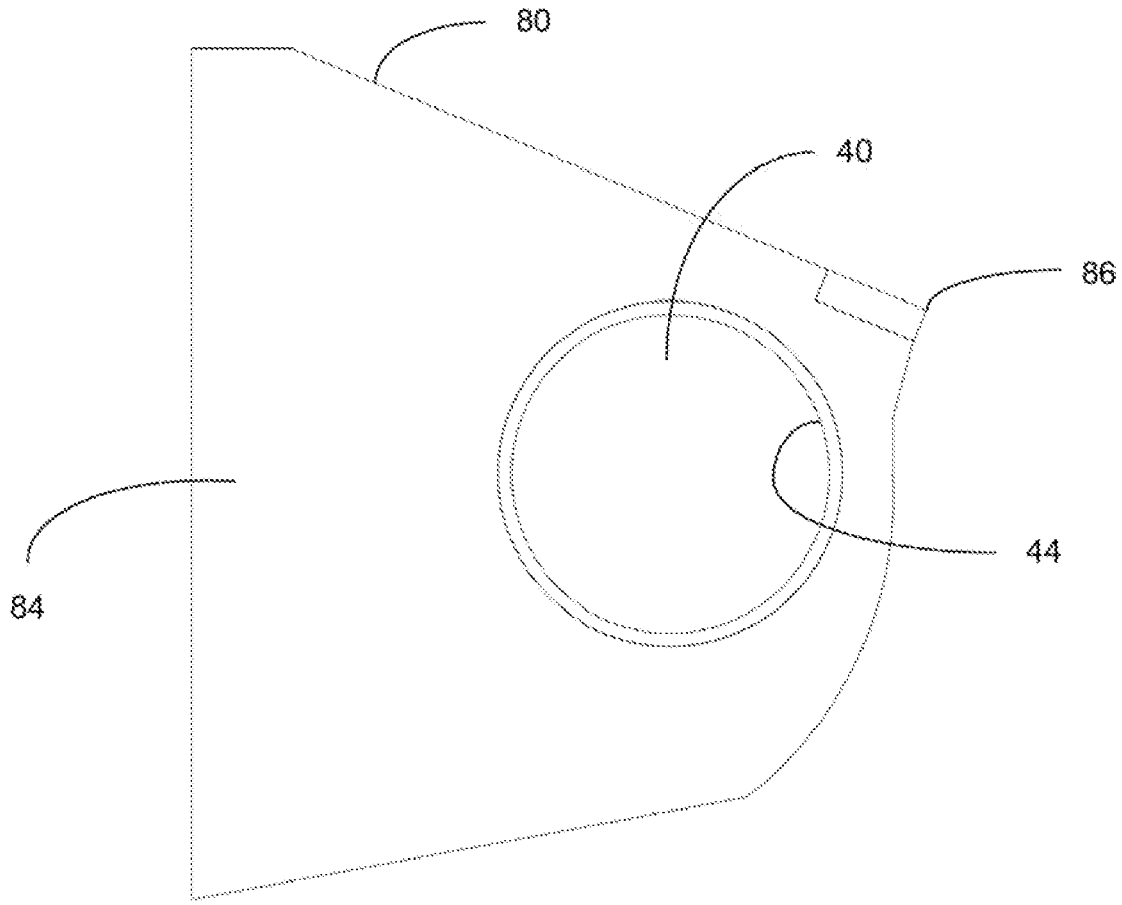
FIG. 3 illustrates a side view of an exemplary embodiment of a stationary bed knife.

FIG. 3 illustrates a side view of an exemplary embodiment of stationary bed knife 80 comprised of plate 84 having cutting edge 86 and aperture 40 for receiving counter-rotating shaft 50 or counter-rotating shaft 55. In the embodiment shown, cutting edge 86 is positioned so that it is perpendicular to the shearing edge of rotary blade 60.

In the embodiment shown, stationary bed knife 80 further includes optional bearing 44. Bearing 44 will be in contact with either counter-rotating shaft 50 (not shown) or counter-rotating shaft 55 (not shown). Bearing 44 equalizes the load between frame 30 (not shown) and counter-rotating shaft 50 or counter-rotating shaft 55 by providing support to frame 30 and stationary bed knife 80. In other embodiments, stationary bed knife 80 may have more or fewer bearings.

Figure 4:
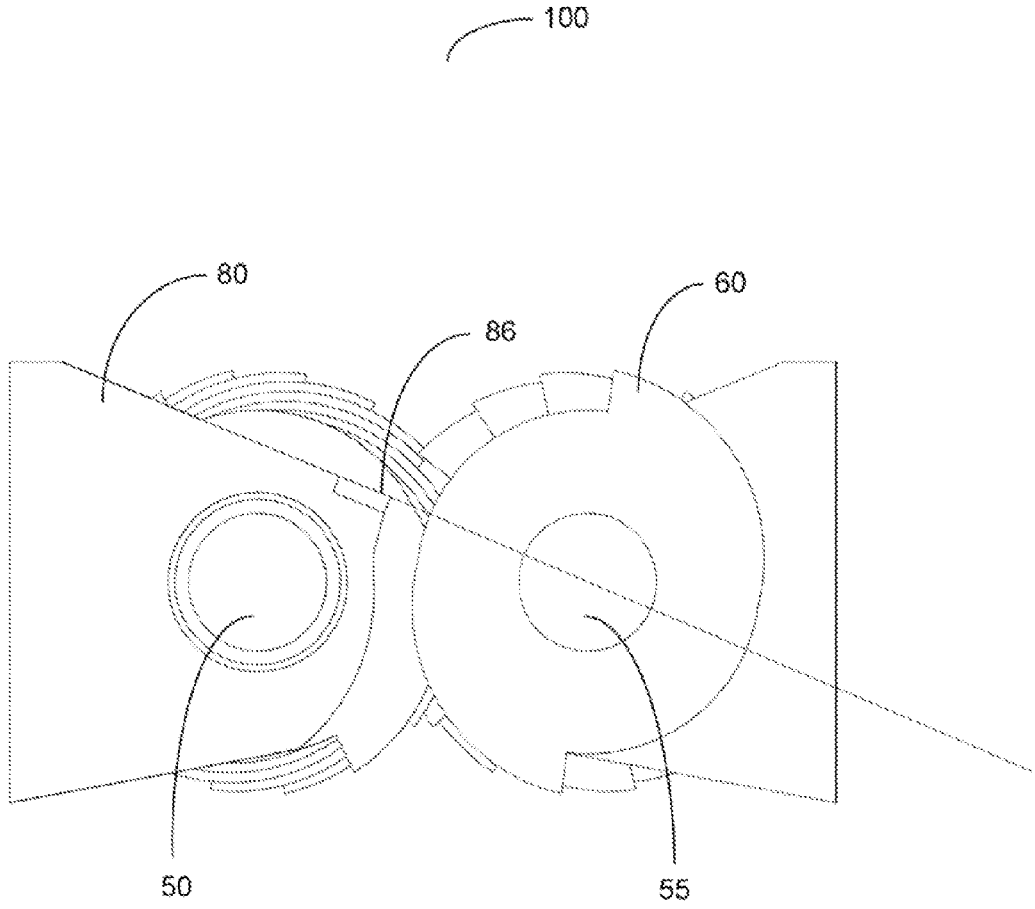
FIG. 4 illustrates an exemplary tangent relationship between a stationary bed knife and a rotary shear blade located opposite one another on counter-rotating shafts.

FIG. 4 illustrates an exemplary tangent relationship between stationary bed knife 80 and rotary shear blade 60 located opposite one another (i.e., stationary bed knife 80 located on counter-rotating shaft 50 and rotary shear blade 60 located on counter-rotating shaft 55).

In the embodiment shown, stationary bed knife 80 is mounted to counter-rotating shaft 50 so that the tangent of cutting surface 86 intersects the center of counter-rotating shaft 55. When stationary bed knife 80 is positioned higher relative to the position of shearing material, the pieces of sheared or granulated material become smaller.

Figure 5A:
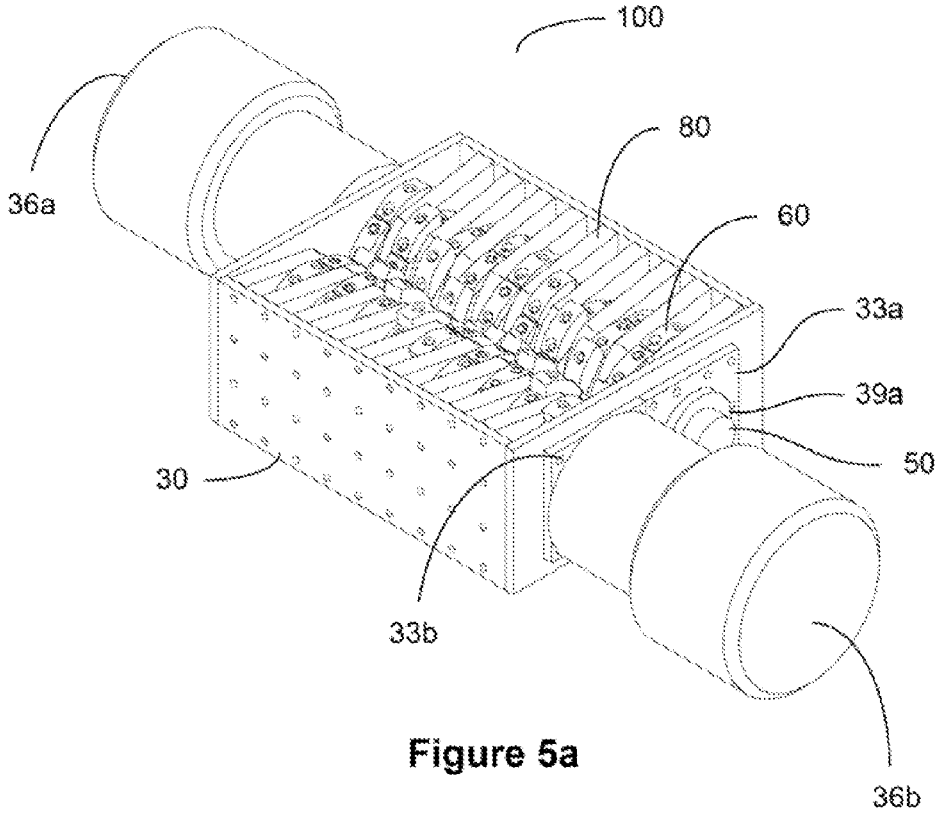
FIG. 5*a* illustrates a perspective view of an exemplary embodiment of a high efficiency single pass shredder-granulator in a frame.

FIG. 5*a* illustrates a perspective view of an exemplary embodiment of high efficiency single pass shredder-granulator 100 in frame 30 with counter-rotating shafts 50 and 55 supported by bearing supports 33*a*, 33*b*, 33*c*, and 33*d* (only 33*a*, 33*b* visible) and end shaft bearings 39*a*, 39*b*, 39*c*, and 39*d* (only 39*a* visible). Bearing supports 33*a*, 33*b*, 33*c*, and 33*d* attach end shaft bearing 39*a*, 39*b*, 39*c*, and 39*d* to frame 30. Also visible are optional tapered roller bearings 36*a* and 36*b*.

In the embodiment shown, rotary shear blades 60 include a plurality of removable shearing protuberances which are bolted to each rotary blade 60. In the embodiment shown, stationary bed knives 80 are bolted to frame 30. Stationary bed knives 80 may be bolted, clamped, welded, integrally constructed, structurally mounted, or affixed to frame 30 by any other means known in the art.

In various embodiments, frame 30 may be enclosed, partially enclosed, or un-enclosed.

In various embodiments, counter-rotating shafts 50 and 50 are driven by a drive apparatus (not shown) which may be powered by one or more power sources including, but not limited to an electric power source, a hydraulic power source, a steam power source, a gas power source, a diesel power source, and a solar power source. For example, a single power source may be used to turn both counter-rotating shafts or each counter-rotating shaft may be turned by an independent power source. High efficiency single pass shredder-granulator 100 may further include a programmable logic interface which is capable of being monitored for selected variables, such as force, pressure, energy, and shaft speed.

Figure 5B:
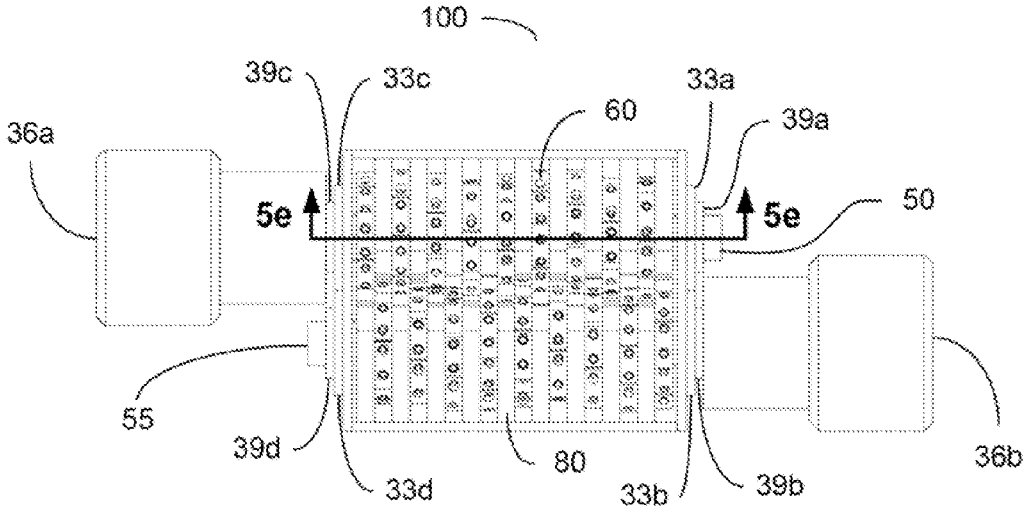
FIG. 5*b* illustrates a top view of an exemplary embodiment of a high efficiency single pass shredder-granulator in a frame.

FIG. 5*b* illustrates a top view of an exemplary embodiment of high efficiency single pass shredder-granulator 100 in frame 30 showing counter-rotating shafts 50 and 55, rotary shear blades 60, stationary bed knives 80, bearing supports 33*a*, 33*b*, 33*c*, and 33*d*, end shaft bearings 39*a*, 39*b*, 39*c*, and 39*d*, and optional tapered roller bearings 36*a* and 36*b*.

Figure 5C:
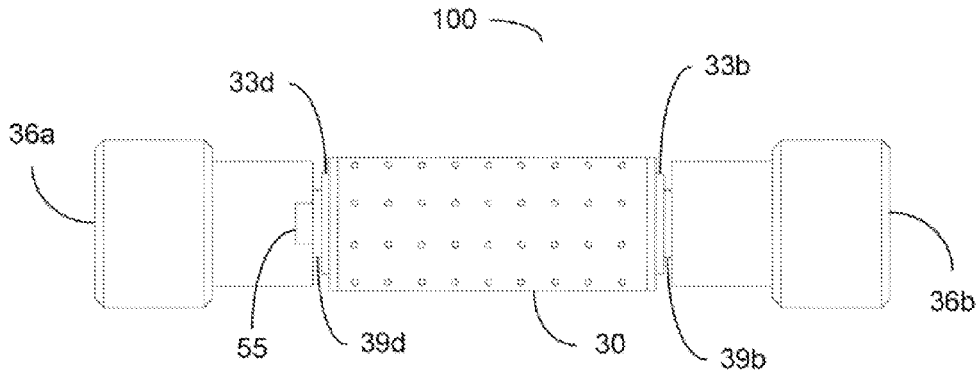
FIG. 5*c* illustrates a front view of an exemplary embodiment of a high efficiency single pass shredder-granulator in a frame.

FIG. 5*c* illustrates a front view of an exemplary embodiment of high efficiency single pass shredder-granulator 100 in frame 30 showing counter-rotating shafts 50 and 55, bearing supports 33*b* and 33*d*, end shaft bearings 39*b* and 39*d*, and optional tapered roller bearings 36*a* and 36*b*.

Figure 5D:
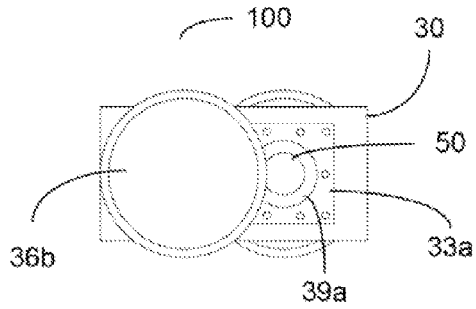
FIG. 5*d* illustrates an end view of an exemplary embodiment of a high efficiency single pass shredder-granulator in a frame.

FIG. 5*d* illustrates an end view of an exemplary embodiment of high efficiency single pass shredder-granulator 100 in frame 30 showing counter-rotating shaft 50, bearing support 33*a*, end shaft bearings 39*a*, and optional tapered roller bearing 36*b*.

Figure 5E:
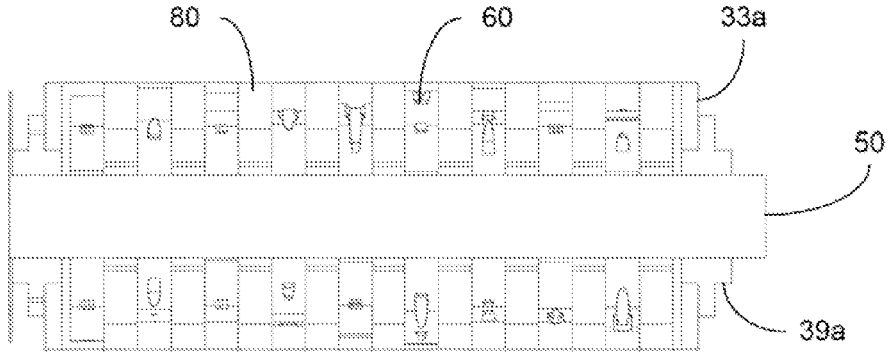
FIG. 5*e* illustrates a cross sectional view of an exemplary embodiment of a counter-rotating shaft of a high efficiency single pass shredder-granulator taken along line 5*e* of FIG. 5*b*.

FIG. 5*e* illustrates a cross sectional view of an exemplary embodiment of counter-rotating shaft 50 taken along line 5*e* of FIG. 5*b*.

Figure 6:
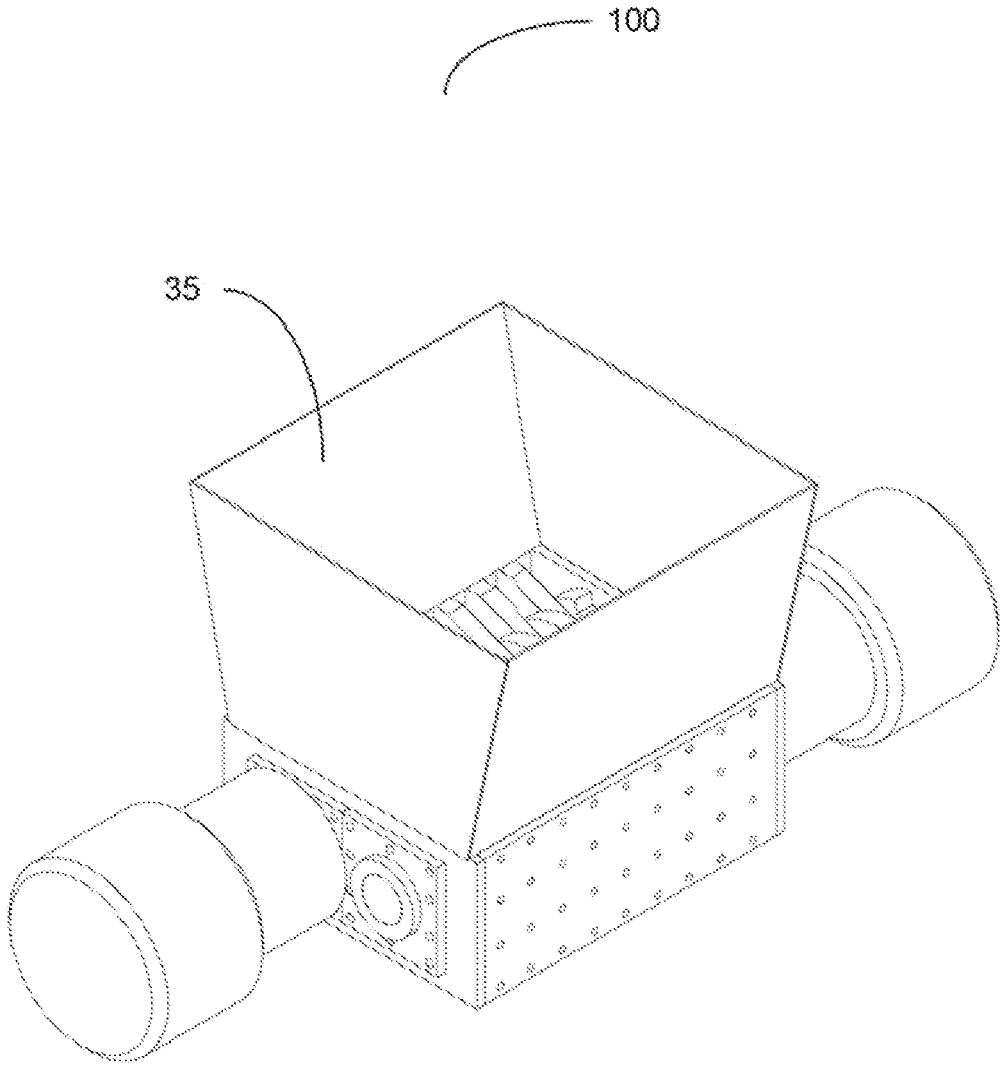
FIG. 6 illustrates a perspective view of an exemplary embodiment of an optional feed chute for a high efficiency single pass shredder-granulator.

FIG. 6 illustrates a perspective view of an exemplary embodiment of high efficiency single pass shredder-granulator 100 with optional feed chute 35. In the embodiment shown, optional feed chute 35 is rectangular with slightly angled sides. In various embodiments, feed chute 35 is a structural component having a square, rectangular, tubular, or curved shape with straight or angled sides. In various embodiments, feed chute 35 may be adapted for manual or automated insertion of material.

What is claimed is:

1. A high efficiency single pass shredder-granulator apparatus comprised of:

a first counter-rotating shaft and a second counter-rotating shaft;

at least two rotary shear blades fixedly attached to said first counter-rotating shaft;

at least one rotary shear blade fixedly attached to said second counter-rotating shaft;

a frame adapted to support said first counter-rotating shaft and said second counter-rotating shaft;

at least one stationary bed knife fixedly attached to a side of said frame that parallels said first and second counter-rotating shafts and which is comprised of a plate having a flattened side surface, a downward tapered surface, an upward tapered surface, a concave shaped surface, at least one cutting edge, and an aperture for receiving one of said counter-rotating shafts;

wherein said cutting edge is positioned to be perpendicular to a shearing edge of said at least one rotary shear blade and is positioned so that a tangent of a cutting edge intersects the center of one of said counter-rotating shafts; and wherein said at least one rotary shear blade and said at least one stationary bed knife are positioned so that they are capable of shearing and shredding material into pieces having edges that are less than one-eighth of an inch.

2. The apparatus of claim 1 wherein said at least two rotary shear blades and said at least one rotary shear blade further include at least one protuberance adapted to apply pressure sufficient to move shearing material to a point between said first counter-rotating shaft and said second counter-rotating shaft and so that there is sufficient pressure across said at least one cutting edge of said at least one stationary bed knife and a shearing surface of at least one of said at least two rotary shear blades and said at least one rotary shear blade.

3. The apparatus of claim 1 wherein said at least one stationary bed knife further includes at least one bearing which is in contact with one of said first counter-rotating shaft and said second counter-rotating shaft and which substantially equalizes the load between said frame and said first counter-rotating shaft or said second counter-rotating shaft by providing support to said frame and said at least one stationary bed knife.

4. The apparatus of claim 1 which further includes at least one feed chute.

5. The apparatus of claim 1 which further includes at least one power source to power movement of said first counter-rotating shaft and said second counter-rotating shaft, said at least one power source selected from a group consisting of electric, hydraulic, steam, diesel, gas, and solar.

6. The apparatus of claim 1 wherein said first counter-rotating shaft and said second counter-rotating shaft may be moved by independent power sources.

7. The apparatus of claim 1 which further includes a programmable logic interface which is capable of being monitored for a variable selected from a group consisting of inch pounds, newtons, foot pounds, and shaft speed.

8. The apparatus of claim 1 wherein said at least two rotary shear blades and said at least one rotary shear blade are configured with at least one shearing protuberance adapted to apply pressure to shredding material, while contemporaneously shearing said shearing material.

9. The apparatus of claim 1 wherein said at least two rotary shear blades are bolted to said first counter-rotating shaft and said at least one shear blade is bolted to said second counter-rotating shaft.

10. The apparatus of claim 1 wherein said at least one stationary bed knife is fixedly attached by a method selected from the grouping consisting of clamping, bolting, welding, and integrally machining as a single part.

11. The apparatus of claim 1 wherein said at least two shear rotary blades and said at least one shear rotary blade are fixedly attached using a bolt or clamp and are replaceable.

12. The apparatus of claim 1 wherein a shearing surface of said at least two rotary shear blades and said at least one rotary shear blade are fixedly attached using a bolt or clamp and are replaceable.

13. The apparatus of claim 1 which is capable of shearing and shredding material selected from a group consisting of rubber, plastic, wood, paper, foam, synthetic materials, tires, metals, aluminum and combinations thereof.

* * * * *